United States Patent [19]

Stuckey

[11] Patent Number: 4,546,678

[45] Date of Patent: Oct. 15, 1985

[54] UNIVERSAL RATCHETING WRENCH

[76] Inventor: William C. Stuckey, 1503 Virginia St., Charleston, W. Va. 25311

[21] Appl. No.: 567,013

[22] Filed: Dec. 30, 1983

[51] Int. Cl.[4] ..... B25B 13/00

[52] U.S. Cl. ..... 81/90.6; 81/91.2

[58] Field of Search ..... 81/91 A, 91 C, 91 R, 81/98, 99, 57.2, 57.33

[56] References Cited

U.S. PATENT DOCUMENTS

| | | | |
|---|---|---|---|
| 328,167 | 10/1885 | Williams . | |
| 651,574 | 6/1900 | Meredith . | |
| 701,462 | 6/1902 | Bettmann et al. | 81/98 |
| 1,061,691 | 5/1913 | Righter . | |
| 1,310,995 | 7/1919 | Langford | 81/91 A |
| 1,466,319 | 5/1922 | Weathersby et al. . | |
| 1,641,260 | 9/1927 | Fletcher . | |
| 1,675,748 | 7/1928 | Bunker | 81/91 C X |
| 1,919,468 | 7/1933 | Jones . | |
| 2,198,951 | 4/1940 | Roush et al. . | |
| 2,224,142 | 12/1940 | Cole . | |
| 2,584,353 | 2/1952 | Keiser | 81/ |
| 2,846,909 | 8/1958 | Mason | 81/57.2 X |

*Primary Examiner*—Frederick R. Schmidt
*Assistant Examiner*—Debra S. Meislin
*Attorney, Agent, or Firm*—Jim Zegeer

[57] ABSTRACT

A ratcheting wrench is comprised of a pair of movable jaws, each provided with clevis extensions which are commonly pivoted together with an operating handle having an integral jaw extension which jaw extension moves between the clevis extensions on each movable jaw. The movable jaws open to permit the wrench to enclose a pipe run, for example, and the jaws are locked in a closed position preferably by a toggle linkage. While the toggle mechanism is latched, the handle can be operated about an enclosed and difficult to access work piece such as a pipe run, or conventionally with respect to nuts and bolts in a ratcheting fashion.

6 Claims, 11 Drawing Figures

FIG. 5
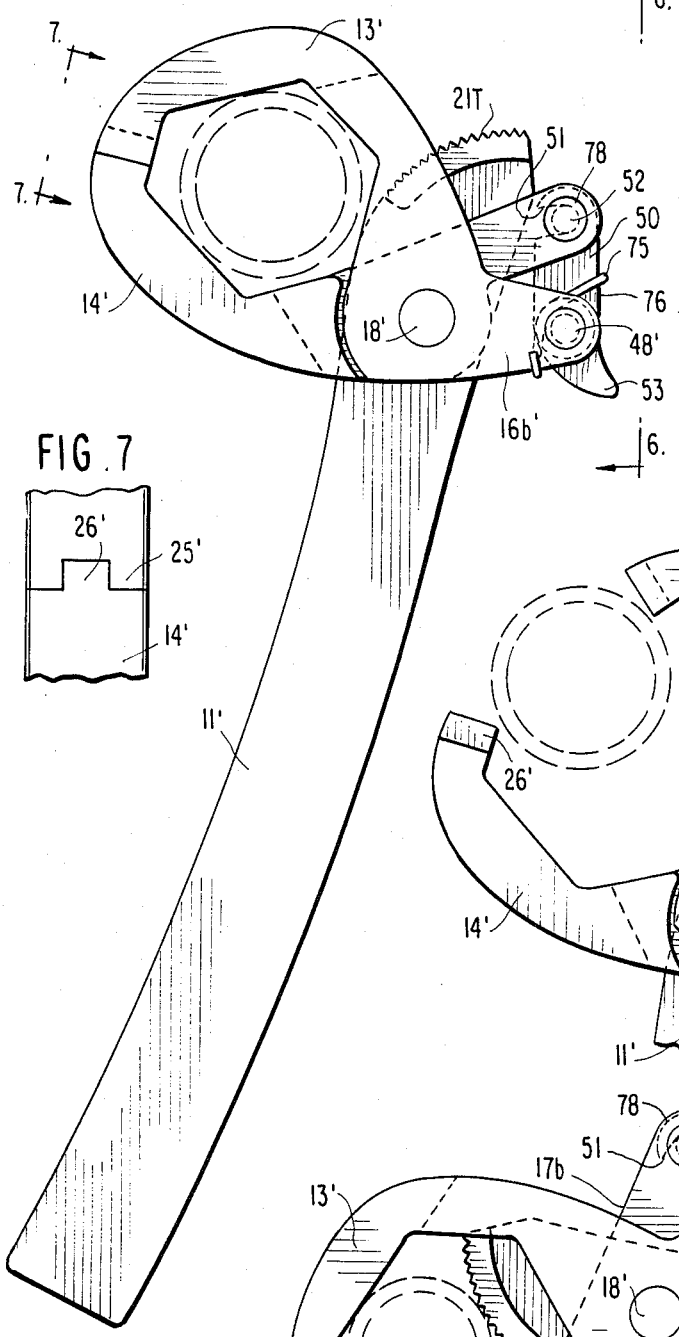
FIG. 6
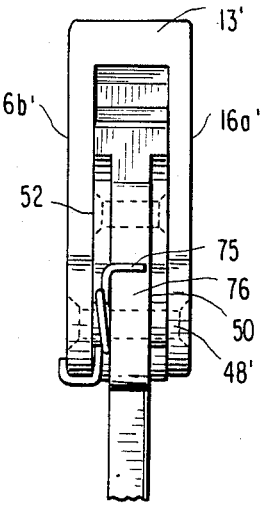
FIG. 7
FIG. 8
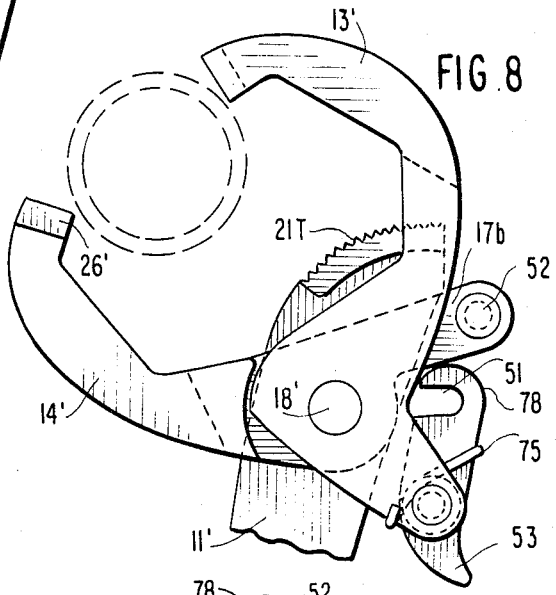
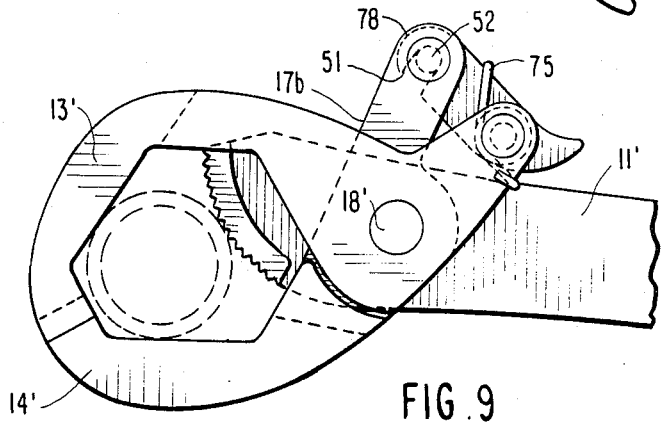
FIG. 9

UNIVERSAL RATCHETING WRENCH

BACKGROUND AND BRIEF DESCRIPTION OF THE INVENTION

Hydraulic lines and fittings are frequently in difficult to reach or access locations and are difficult to work with, particularly by means of ratchet type wrenches, so, in general, open type box wrench, crescent wrenches, vice grip type pliers, and the like, are used and in such cases, the wrench must be removed at the end of each turn and reapplied for each subsequent operation. Moreover, hydraulic lines and fittings are frequently thin walled and made of mallable metal, such as brass and/or aluminum so they are frequently easily damaged by crescent wrenches, vice grip type pliers and box wrenches.

In Bettman and Talkenton U.S. Pat. No. 701,462, there is disclosed a ratchet type wrench which is quite popular today. In the Bettman and Talkenton wrench, a closed jaw member is fixedly fulcrummed or pivotted on a handle member through a clevis with a toothed extension portion of the handle member moving through the clevis on the closed jaw members to engage a nut or work member. It is impossible to work on continuous pipe with the Bettman and Talkenton wrench. Keiser U.S. Pat. No. 2,584,353 discloses a ratcheting jaw for plier type wrenches in which the jaws of the plier type wrench are actuated by a locking toggle mechanism.

Objects of the present invention are to provide an improved ratcheting wrench of the Bettman and Talkenton and Keiser types. A further object of the invention is to enlarge the area of usefulness of wrenches of the Bettmann and Talkenton type. Another object of the invention is to permit use of such wrenches on pipes, tubes, nuts and the like which may be in difficult to access places. A further object of the invention is to provide a ratchet wrench of the Bettmann and Talkenton type which is useful in difficult to access spaces and which is relatively low in manufacturing cost.

The present invention is an improvement over the wrenches of the Bettmann and Talkenton type in that the wrench jaws open to enclose pipes and runs, such as hydraulic, air or other fluid lines, plumbing in houses, as well as nuts, bolts and fittings of all kinds.

According to this invention, a pair of movable jaws, each provided with a clevis extension, are commonly pivotted together with an operating handle having an integral jaw extension which extension moves between the clevis extensions on each movable jaw, respectively. The movable jaws open to permit the wrench to enclose a pipe run, for example and the jaws are locked in a completely closed position preferrably by a toggle linkage extending between link elements, said pair of movable jaws, respectively. When the toggle mechanism is closed, the wrench operates similarly to the Bettman and Talkenton wrench. An enlargement on the handle extension evenly distributes the loading over the work piece and minimize damages to thin wall piping, tubing or the like. A projection is formed on one of the jaw elements to fit between a complementarily shaped notch in the opposing jaw. In one embodiment, the jaws are latched by a simple latch instead of the toggle linkage.

BRIEF DESCRIPTION OF THE DRAWINGS

The above and other objects, advantages and features of the invention will become more apparent when considered with the following specification and accompanying drawings wherein:

FIG. 5 is a side elevational view of a further embodiment of the invention, FIG. 6 is an end view looking in the direction of arrows 6—6 on FIG. 5, FIG. 7 is an end view looking in the direction of arrows 7—7 on FIG. 5, FIG. 8 is a side elevational view showing the application of the wrench to a work piece (a pipe), FIG. 9 is a side elevational view showing the wrench jaws in a closed and latched position on a work piece (a smaller pipe than in FIG. 8)

DETAILED DESCRIPTION OF THE INVENTION

Figure 1:
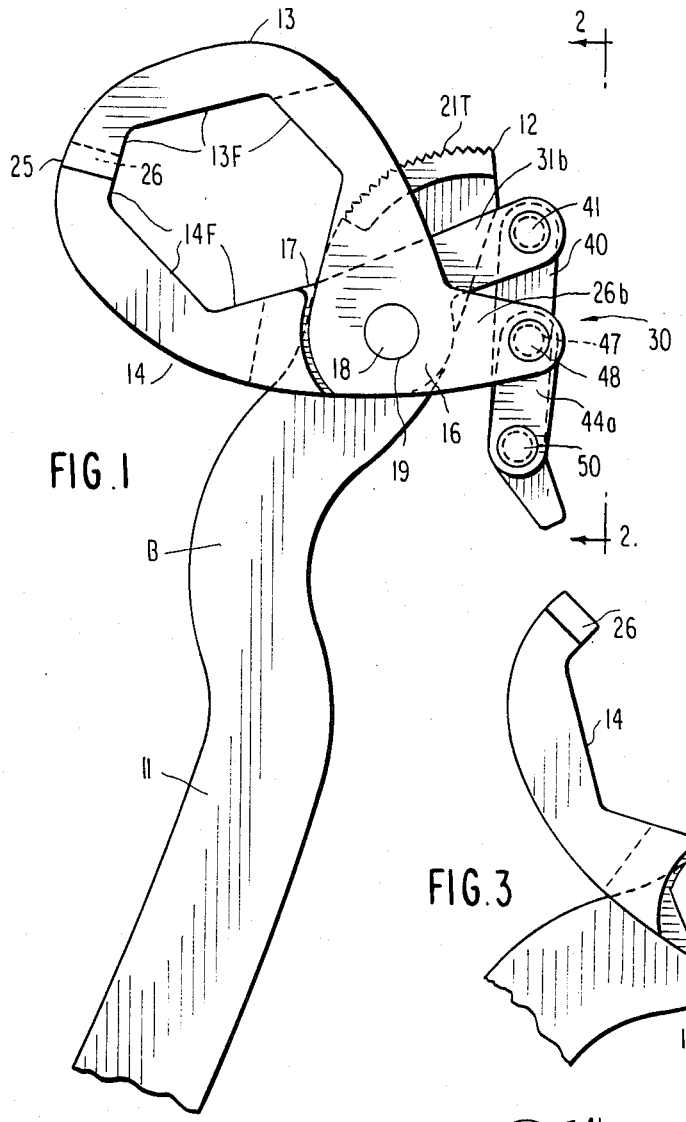
FIG. 1 is a side elevational view of a preferred embodiment of the invention.
Figure 2:
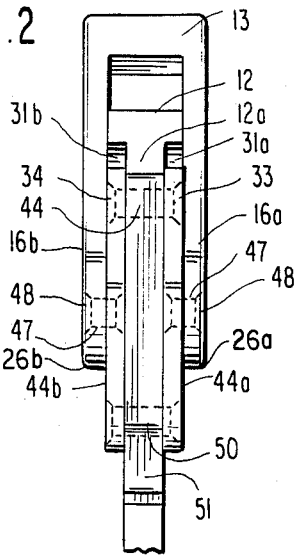
FIG. 2 is an end view looking in the direction of arrows 2—2 on FIG. 1.
Figure 3:
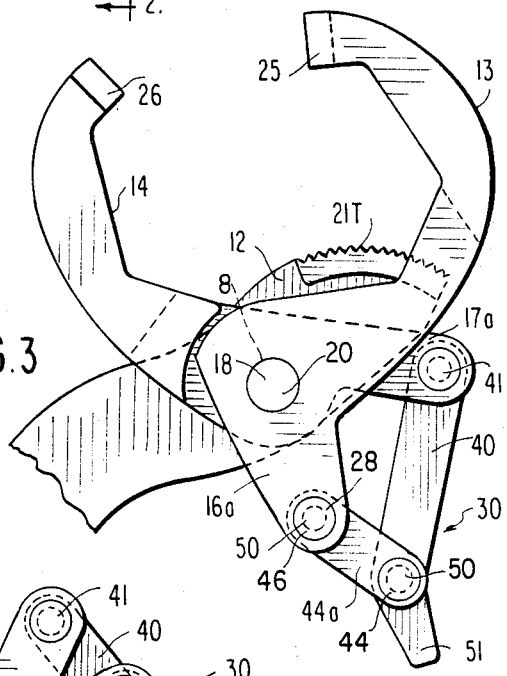
FIG. 3 is a partial side elevational view showing the jaws opened and unlatched.

Referring now to FIGS. 1–4, the wrench 10 includes an operating handle member 11, which has an ratcheting jaw element 12 integrally formed thereon, and a pair of article encircling movable jaw elements 13 and 14, respectively, each of these movable jaw elements having clevis portions 16 and 17, respectively, integrally formed therewith. Handle member 11 and jaw members 13 and 14 can be formed with castings or forgings which may be treated in conventional fashion for hardening purposes. A common pivot pin 18 passes through the fulcrum point 19 in handle 11 and the corresponding fulcrum points 20 and 8 in the clevis link extensions 16 and 17 respectively of jaw members 13 and 14, respectively. Thus, the clevis leg portions **16*a* and 16*b* of jaw member 13 form the outer most two plates of the assembly for the wrench, the legs 17*a* and 17*b* of clevis 17 fit within and between the legs 16*a* and 16*b* of clevis 16 (it being appreciated that the relative positions of the parts may be changed or reversed) and, finally, the portion 12*a* of the handle member jaw element 12 is fitted between the leg 17*a* and 17*b* of clevis 17. The enlarged article engaging portion 21 is provided with teeth elements 21T for better gripping purposes but, these are of insufficient sharpness and depth to damage any pipe. These elements 21** are broadened so as to more evenly distribute loading over the surface of the work piece to avoid damage to the work piece.

End 25 of jaw element 14 is bifurcated or split so as to receive in a complementary fashion projection 26 on jaw element 13.

Toggle linkage 30 includes a pair of extension link members 26 and 27 and are provided for opening and lockingly closing jaw elements 13 and 14 relative to ratcheting jaw element 12. In the preferred embodiment, a pair of extension link members **26*a* and 26*b* form the legs of clevis 16 for jaw element 13 and extend from common pivot 18 to further pivot 28 at the ends of link extensions 26***a* and 26*b*, respectively. Link 27 is constituted by a further link pair 31*a* and 31*b* formed as integral parts of the clevis 17 and extend between common pivot 18 and pivot holes 33, 34 in clevis 17.

A toggle operating link 40 is pivotted on a pivot pin 41 passing through pivot holes 33 and 34 and pivot hole 41 in link 40. A pair of toggling links 44*a* and 44*b* is pivotted on pivot 28 on links 26*a* and 26*b* and pivot hole 46 on toggling links 44. A further pivotting connection for toggling links 44 includes pivot hole 47 and pivot pin 48 passing through pivot hole 50 on toggle operating link member 40. Operating arm 51 extends beyond pivot hole 50 and is relatively short to permit manipulative operation by the fingers of the user in close working quarters.

Figure 4:
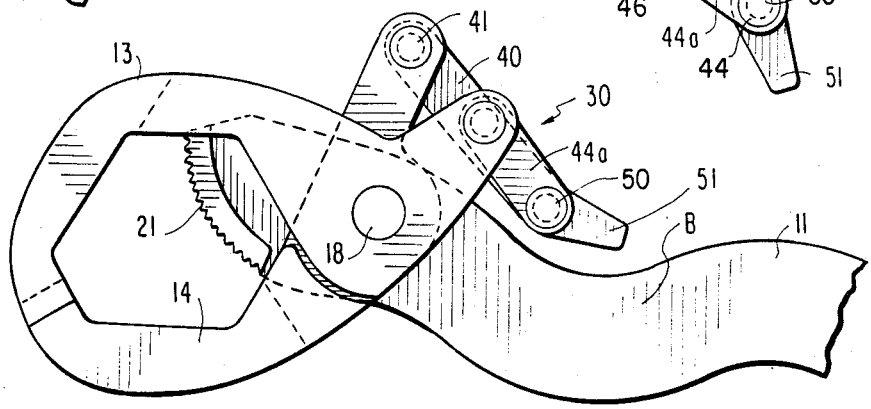
FIG. 4 is a side elevational view similar to FIG. 1 with the article engaging jaw portion of the operating handle in one working position.

When the toggle operating link 40 is moved by operating arm 51 to pivot about pivot pin 41, the jaw 14 and jaw 13 are moved apart relative to each other about common pivot pin 18. Jaw 12 remains, of course, stationary relative to pivot 18. With the jaws 13 and 14 spread apart, the wrench can then be fitted upon a pipe at some nearly inaccessable place. When the operating arm 51 is moved such that pivot 48 passes beyond pivots 41 and 48, e.g., the overcenter or toggle point, the jaws 13 and 14 are lockingly closed and in this condition, the wrench can be operated in a ratcheting fashion very much in the manner of the Bettmann and Talkenton patent. The bend B in handle 11 accomodates a portion of the toggle mechanism as shown in FIG. 4. Soft metal pipes and fittings and other work pieces are not damaged by any squeezing action since the opening end of the closed jaws 13 and 14 is such that the work piece is not clamped thereby. Operation of the operating handle brings the broad surface of jaw 21 to bear on the work piece to turn it in the desired direction, the flat surfaces 13F and 14F of jaws 13 and 14 tangentially engaging round surfaces and flat face to flat face with nuts and the like.

In the embodiment shown in FIGS. 5–9, the toggle operating link 40 and toggling link 44 of FIGS. 1–4 have been replaced by a latching link 50. Latching link 50 prevents the jaws 13' and 14' from opening after they have been closed by the user to encircle pipe run, for example. Latch link 50 is provided with a hook slot 51 which hooks on latch bar 52. As shown in FIG. 9, the rounded end 53 of latch link 50 is rounded so as to be engaged by finger to disengage hook slot 51 on latch link 50. A spring 75 hooked on the outside edge 76 of latch 50, and looped around pivot 48 and hooked on clevis plate 16*b'* biases the latch 50 closed. When the latch pin 52 cams the end 78 of latch 50 outwardly until the slot 51 is over pin 52 and spring 75 bias the latch to engage slot 51 with pin 52.

Figure 10:
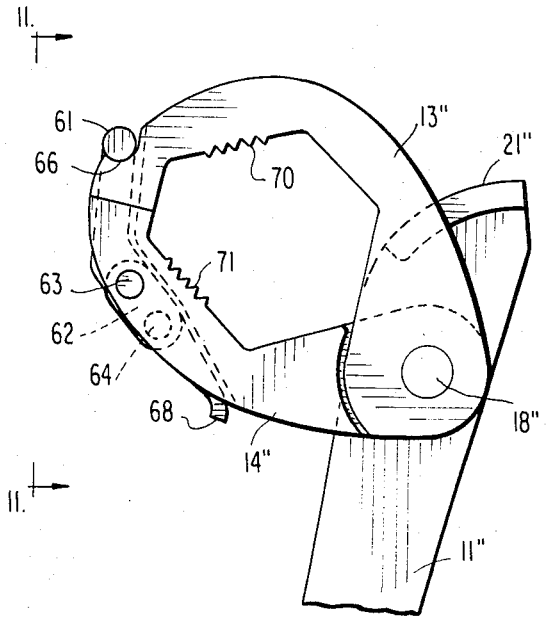
FIG. 10 is a side elevational view of a further embodiment of the invention.
Figure 11:
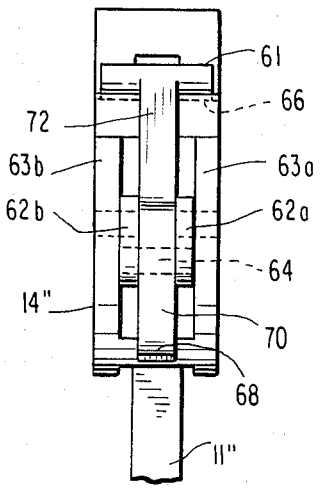
FIG. 11 is an end view looking in the direction of arrows 11—11 on FIG. 10.

In the embodiment shown in FIGS. 10 and 11, the toggle linkage 30 of FIG. 1 has been shifted to the ends of jaws 13" and 14" and has the toggle latch mechanism arranged such that only a small portion of the toggle linkage is exposed and there are substantially no protrusions which could decrease the angle of travel of the tool when working in tight quarters. In this case, the toggle operating link 60 has a hook or bar member 61. A toggling link pair 62*a* and 62*b* is pivotted at 63*a* and 63*b* on jaw 14", and on toggle operating link 60 at 64. Hook or bar member 61 is rounded and is received in rounded notch or cut-out 66 in jaw 13". When operating handle or tab member 68 of toggle operating link 60 is moved clockwise (in FIG. 10), pivot 64 is moved over-center relative to pivots 63 and 64 to loosen hook or bar 61 from notch 66 and thereby release jaw 13" from jaw 14" and permit the wrench to be opened and applied to a pipe, for example. When hook or bar 61 is aligned with notch 66 and the operating handle or tab 68 is rotated or turned in a counter-clockwise direction, and pivot 64 moves over-center, jaws 13" and 14" are drawn together and locked in the wrench operating position. In this embodiment, a slot or notch 70 is formed in jaw 14" to receive and accomodate the toggle mechanism. A slot or notch 71 is formed in the end of jaw 13" to receive and accomodate a portion 72 of operating toggle link 60.

As shown in FIG. 10, the work piece engaging surfaces of jaws 13" and 14 may have portions 70, 71 thereof roughened or knurled so as to better grip round fittings such as garden hose fittings, couplings and the like and still be used on bolts, nuts, etc. with minimum damage thereto.

While there has been shown and described the preferred embodiment of the invention, it will be appreciated that modifications and adaptations of the invention that come within the spirit and scope of the invention as defined by the claims can be made and it is intended that such modifications and adptations be encompassed by thge claims appended hereto.

What is claimed is:

1. A universal ratcheting wrench comprising, in combination, a pair of jaw elements, each having a pair of ends and a common pivot means therefor intermediate said ends, each said jaw element having an article engaging jaw on one of said ends, respectively, a handle member, said handle member having a ratcheting jaw element integrally formed therewith, said handle being pivotally connected to said pair of jaw elements by said common pivot means with said ratcheting jaw element movable between said pair of jaw elements, toggle linkage means for lockingly closing said pair of jaw elements relative to said ratcheting jaw element and an article on which said wrench is to be used, said toggle linkage means includes an extension link integral with a first of said pair of jaw elements and on an opposite end from said article engaging jaw on said first of said pair of jaw elements, the other of said pair of jaw elements having a further link extension integral with and on the opposite end from said article engaging jaw on said other of said jaw elements, an operating link member pivotally connected at one end to one of said extention links at a position spaced from said common pivot means, and a toggling link pivotally connected first by a second toggle link pivot to the other of said extension links at a point remote from said common pivot and secondly by a third toggle link pivotted to said operating link at a point thereon such that when said operating link is moved toward said common pivot, said pair of article engaging jaws move toward each other to encircle an article and lock when said toggle

2. A universal ratcheting wrench comprising, in combination, a pair of jaw elements, each having a pair of ends and a common pivot means therefor intermediate said ends, each said jaw element having an article engaging jaw on one of said ends, respectively, a handle member, said handle member having a ratcheting jaw element integrally formed therewith, said handle being pivotally connected to said pair of jaw elements by said common pivot means with said ratcheting jaw element movable between said pair of jaw elements, latch link means for lockingly closing said pair of jaw elements relative to said ratcheting jaw element and an article on which said wrench is to be used, said latch link means including a first pair of spaced apart legs integral with one of said pair of jaw elements and on an opposite end from said one of said pair of article engaging jaw thereon, a second pair of spaced apart legs integral with the other of said jaw elements and on an opposite end from said article engaging jaw thereon, a latching link pivotally mounted at one end between one of said pair of spaced apart legs, and a hooking member formed on the other end of said latching link, and a cooperating hooking member formed on said second pair of spaced apart legs.

3. The universal ratcheting wrench defined in claim 2 wherein said ratcheting jaw element is broad and passes between one of said pair of spaced apart legs to engage an article.

4. The universal ratcheting wrench defined in claim 2 including spring means for biasing said latching link to a latching position.

5. The universal ratcheting wrench defined in claim 4 including an extension on said latching link for engagement by the finger of the user to disengage said cooperating hooking member from said hooking member.

6. The universal ratcheting wrench defined in claim 2 wherein said handle member has a bend therein on the side of said common pivot opposite said ratcheting jaw element and adjacent said common pivot.

* * * * *